US009603233B2

(12) United States Patent
Perkins

(10) Patent No.: US 9,603,233 B2
(45) Date of Patent: Mar. 21, 2017

(54) PARTICLE ACCELERATOR WITH A HEAT PIPE SUPPORTING COMPONENTS OF A HIGH VOLTAGE POWER SUPPLY

(75) Inventor: Luke Perkins, Plainsboro, NJ (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 963 days.

(21) Appl. No.: 13/884,889

(22) PCT Filed: Nov. 9, 2011

(86) PCT No.: PCT/US2011/059869

§ 371 (c)(1),
(2), (4) Date: Jul. 26, 2013

(87) PCT Pub. No.: WO2012/064801

PCT Pub. Date: May 18, 2012

(65) Prior Publication Data

US 2013/0294557 A1 Nov. 7, 2013

Related U.S. Application Data

(60) Provisional application No. 61/412,604, filed on Nov. 11, 2010.

(51) Int. Cl.

| | |
|---|---|
| ***H05H 3/06*** | (2006.01) |
| ***G21G 4/02*** | (2006.01) |
| ***H05H 7/02*** | (2006.01) |

(52) U.S. Cl.

CPC ..... *H05H 3/06* (2013.01); *G21G 4/02* (2013.01); *H05H 7/02* (2013.01); *H05H 2007/022* (2013.01); *H05H 2007/025* (2013.01)

(58) Field of Classification Search

CPC ... G21B 1/19; G21G 4/02; G21G 5/08; G21G 2201/065; G21G 2201/067;

(Continued)

(56) References Cited

U.S. PATENT DOCUMENTS 2,935,633 A * 5/1960 Peters ..... H05H 6/00 313/311
3,571,595 A * 3/1971 Silver ..... G21G 4/02 376/191

(Continued)

FOREIGN PATENT DOCUMENTS

| | | | |
|---|---|---|---|
| EP | 1857762 | A1 | 11/2007 |
| WO | 2008044823 | A1 | 4/2008 |
| WO | 2009006024 | A1 | 8/2009 |

OTHER PUBLICATIONS

GH Induction Atmospheres, "The Brazing Guide," Jun. 2010.*

(Continued)

*Primary Examiner* — Jack W Keith
*Assistant Examiner* — Sharon M Davis
(74) *Attorney, Agent, or Firm* — Michael Dae

(57) ABSTRACT

A pulsed neutron generator includes neutron tube and a high voltage power supply. High voltage power supply includes a bulkhead and plurality of electronic components electrically connected between the bulkhead and the target of the neutron tube. A heat pipe is provided in thermal contact with the target and has a housing portion with an exterior surface supporting the plurality of electronic components of the high voltage power supply. Heat pipe includes wick and heat transfer fluid disposed within the housing portion. The wick for recirculates the heat transfer fluid within the housing portion in order to transfer heat away from the target preferably to the bulkhead for dissipation the system housing. Both the wick and heat transfer fluid are preferably realized from materials that have low electrical conductivity.

(Continued)

The heat pipe can also be part of other-type particle accelerators, such as x-ray sources and gamma-ray sources.

28 Claims, 4 Drawing Sheets

(58) Field of Classification Search
CPC ..... H05H 3/06; H05H 6/00; H01L 23/427; F28D 15/02; F28D 15/0275
USPC ..... 376/108, 114, 115, 150; 250/269.4
See application file for complete search history.

(56) References Cited

U.S. PATENT DOCUMENTS 3,775,216 A * 11/1973 Frentrop ..... G01V 5/10 156/293
3,836,785 A * 9/1974 Reifenschweiler ..... H05H 6/00 376/114
4,076,990 A 2/1978 Hendry et al.
4,984,261 A 1/1991 Maldonado et al.
5,486,703 A * 1/1996 Lovin ..... A61L 2/08 250/492.3
5,509,472 A * 4/1996 Tamura ..... F28F 13/00 165/168
6,263,046 B1 7/2001 Rogers
6,377,659 B1 4/2002 Snyder et al.
2007/0209790 A1 9/2007 Kiefer et al.
2007/0251673 A1 11/2007 Hou et al.
2008/0121389 A1* 5/2008 Zillmer ..... F28D 15/0208 165/185
2009/0008063 A1 1/2009 Salinas et al.
2009/0108192 A1 4/2009 Groves et al.
2010/0059665 A1 3/2010 Sampayan
2010/0078151 A1 4/2010 Koenigsberg et al.

OTHER PUBLICATIONS

Walker and Hodges, "Comparing Metal-Ceramic Brazing Methods," Welding Journal, Oct. 2008, pp. 43-50.*
Accuratus, Aluminum Nitride and Aluminum Oxide Ceramic Properties.*
Weirauch, "Mechanical and Environmental Tests of Brazed Ceramic Multiplayer Packages" Welding Research Supplement, May 1994, pp. 110-118.*
International Search Report for PCT Application Serial No. PCT/US2011/059869 dated May 23, 2012.
Examination Report for GC Application No. 2011-19710 dated Dec. 7, 2014.

* cited by examiner

PARTICLE ACCELERATOR WITH A HEAT PIPE SUPPORTING COMPONENTS OF A HIGH VOLTAGE POWER SUPPLY

BACKGROUND OF THE INVENTION

1. Field of the Invention

This invention relates broadly to particle accelerators and specifically to particle accelerators (such as pulsed neutron generators, x-ray sources and gamma ray sources) used in the oilfield industry. More particularly, this invention relates to a high voltage power supply for a particle accelerator that has an intended use in boreholes particularly at elevated temperatures.

2. State of the Art

Pulsed neutron generators are well known in the art. Typically, a pulsed neutron generator (PNG) is an electronic radiation generator that operates at high voltages. The PNG typically incorporates a neutron tube (commonly referred to as a "Minitron") that produces neutrons by fusing together hydrogen isotopes. More particularly, an ion beam of deuterium or tritium ions are typically accelerated into a metal hydride target that contains deuterium and/or tritium. Fusion of deuterium atoms (D+D) at the target results in the formation of a $^{3}$He ion and a neutron with a kinetic energy of approximately 2.4 MeV. Fusion of a deuterium atom and a tritium atom (D+T) at the target results in the formation of a $^{4}$He ion and a neutron with a kinetic energy of approximately 14.1 MeV. Fusion of tritium atoms (T+T) at the target results in the formation of a $^{4}$He ion and two neutrons with a kinetic energy within a range from 2 MeV to 10 MeV.

The neutron tube typically has several components including:

- a gas reservoir (e.g., a filament or hydrogen-gettering material made of metal hydride) to supply reacting gas molecules (such as deuterium and/or tritium);
- an ion source that strips electrons from the gas molecules thus generating a plasma of electrons and positively charged ions; these ions are extracted from the plasma so as to form an ion beam;
- a target with reacting gas molecules stored in a metal hydride layer; and
- an accelerating gap that propels the ions of the ion beam to the target with sufficient energy to cause the desired fusion reaction.

All of these components are supported within a vacuum tight enclosure realized by glass and/or ceramic insulators, fused or brazed to metal washers and plates.

Ordinarily, a plasma of positively charged ions and electrons is produced by energetic collisions of electrons and neutral gas molecules within the ion source. Two types of ion sources are typically used in neutron generators for well logging tools: a cold cathode (a.k.a. Penning) ion source, and a hot (a.k.a. thermionic) cathode ion source. These ion sources employ anode and cathode electrodes of different potential that contribute to plasma production by accelerating electrons to energy higher than the ionization potential of the gas. Collisions of those energetic electrons with gas molecules produce additional electrons and ions. Other suitable ion sources can also be used.

Penning ion sources increase collision efficiency by lengthening the distance that the electrons travel within the ion source before they are neutralized by striking a positive electrode. The electron path length is increased by establishing a magnetic field which is perpendicular to the electric field within the ion source. The combined magnetic and electrical fields cause the electrons to describe a helical path within the ion source which substantially increases the distance traveled by the electrons within the ion source and thus enhances the collision probability and therefore the ionization and dissociation efficiency of the device. Examples of neutron generators including Penning ion sources used in logging tools are described in U.S. Pat. No. 3,546,512 or 3,756,682 both assigned to Schlumberger Technology Corporation.

Hot cathode ion sources comprise a cathode realized from a material that emits electrons when heated. An extracting electrode (also called a focusing electrode) extracts ions from the plasma and focuses such ions so as to form an ion beam. An example of a neutron generator including a hot cathode ion source used in a logging tool is described e.g. in U.S. Pat. No. 5,293,410, assigned to Schlumberger Technology Corporation.

During operation, high voltage power supply circuitry provides a negative high voltage signal to the target such that the target floats at a voltage potential typically on the order of −70 kV to −160 kV DC. The gas reservoir is controlled to adjust the gas pressure within the neutron tube as desired. The gas pressure is adjusted by the heating power levels supplied to the filament or gotten by a gas reservoir. A pulsed-mode ion source power supply circuit supplies pulsed-mode power supply signals around ground potential (for example, pulses on the order of 200V) to the ion source such that ion source produces a pulsed-mode ion beam that is accelerated by the DC electric field gradient in the accelerating gap between the extraction electrode and the target. The electric field gradient is adapted to provide enough energy that the bombarding ions at the target generate and emit neutrons therefrom. Pulse-width modulation of the power supply signals provided to ion source can be used to control the power of the ion beam and therefore the neutron output as desired.

A suppressor electrode shrouding the target can be provided within a vacuum tight enclosure. The suppressor electrode acts to prevent electrons from being extracted from the target upon ion bombardment (these extracted electrons are commonly referred to as secondary emission electrons). To do so, a negative voltage potential difference is provided between the suppressor electrode and the target of a magnitude typically between 200V and 1000V.

The vacuum tight enclosure and the high voltage power supply circuitry are surrounded by high voltage electrical insulating material, and the resulting structure is enclosed in a hermetically-sealed metal housing. The housing is typically filled with a dielectric media (e.g., SF6 gas) to insulate the high voltage elements of the electronics and neutron tube. External power supply circuitry supplies power supply signals via electrical feedthroughs to the high voltage electronics as well as to the gas reservoir and ion source as needed.

During operation, the reaction of the ion beam at the target produces heat thereon. The high voltage insulating materials of the neutron tube that surrounds the target typically have poor thermal conductivity. Consequently, operation of the neutron tube can result in a heat build at the target, which can cause significant degradation of neutron output.

SUMMARY OF THE INVENTION

In accord with one embodiment of the invention, a pulsed neutron generator is provided that includes a neutron tube, which is referred to herein as a "Minitron". The Minitron of the present invention employs a vacuum tight enclosure that encloses and supports a gas reservoir (e.g., a filament or hydrogen-getter material made of metal hydride), an ion source, an accelerating gap and a target containing a metal hydride layer. A high voltage power supply is provided that includes a bulkhead at one end and a high voltage multiplier circuit (preferably a Cockcroft-Walton ladder circuit) that is electrically coupled to the target of the Minitron. A heat pipe is located between the bulkhead of the high voltage power supply and the target of the Minitron, with the external housing of the heat pipe supporting the components (e.g., capacitors, diodes and interconnects) of the high voltage multiplier circuit. The external housing of the heat pipe is preferably constructed from a material which is highly electrically insulating and highly thermally conductive. The heat pipe is thermally coupled to the target of the Minitron and houses internal elements including a wick and heat transfer fluid. The wick provides for circulation of heat transfer fluid within the heat pipe to carry heat away from the target of the Minitron. Both the wick and heat transfer fluid are preferably realized from materials that have very low electrical conductivity. Thus, in different embodiments the wick may be made from ceramic powder, ceramic fiber wick, or glass fibers, and the heat transfer fluid may be a pressurized deionized water or possibly diluted glycol.

According to one aspect of the invention, the heat pipe housing is realized from a material that is electrically insulating with a sheet resistance greater than $10^{14}$ ohms/square and that is thermally conductive with thermal conductivity greater than 20 W/m-K (watts per meter Kelvin). In one embodiment, the heat pipe housing is formed from aluminum nitride (AlN) ceramic. In another embodiment, the heat pipe housing is formed from beryllium oxide (BeO) ceramic. In yet another embodiment, the heat pipe housing is formed from aluminum oxide ($Al_2O_3$) ceramic.

According to one embodiment of the invention, the heat pipe includes a ceramic body whose opposite ends are brazed to respective metal end-caps. The metal end-cap on one end of the heat pipe can be shaped to mate to and conform to the exposed body of the target of the Minitron to provide for efficient thermal coupling therebetween and provide a Faraday cage that limits the corona effect of an external electrical field on the target. The metal end-cap on the opposite end of the heat pipe can be shaped to mate to and conform to a terminal part of the bulkhead of the high voltage power supply to provide for efficient thermal coupling therebetween. One of the metal end-caps (preferably the end-cap that mates to the bulkhead of the high voltage power supply) can contain a fill port for filling the heat pipe with heat transfer fluid. This fill port can be a threaded design with a cap or can be a pinch-off design. Various configurations for the ceramic body and metal end-caps can be utilized, and the brazing can be a circumferential or annular braze and/or a butt or face braze.

Objects and advantages of the invention will become apparent to those skilled in the art upon reference to the detailed description taken in conjunction with the provided figures.

DETAILED DESCRIPTION OF THE PREFERRED EMBODIMENTS

Figure 1:
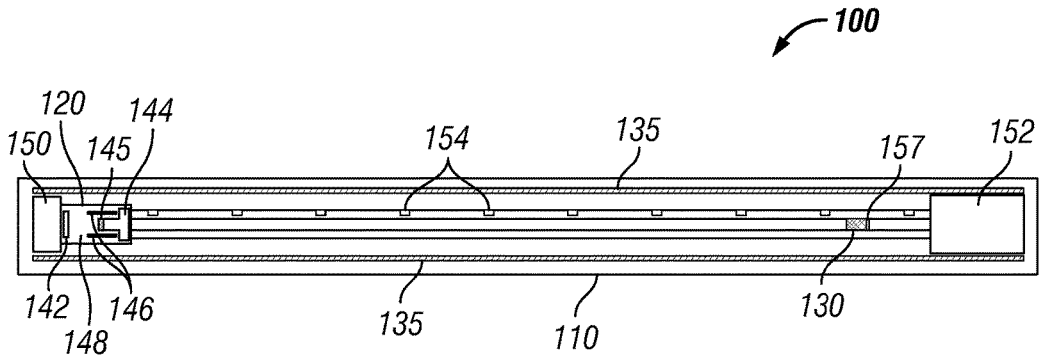
FIG. 1 (PRIOR ART)
FIG. 1 is a block diagram of a prior art pulsed neutron generator.

Before describing details of the invention, an understanding of the layout of a prior art pulsed neutron generator (PNG) is useful. As seen in FIG. 1, a PNG 100 is provided with an external housing 110 in which a neutron tube (Minitron) 120 and a high voltage power supply 130 are located. One or more electrically-insulating sleeves 135 are provided between the external housing 110 and the Minitron 120 and high voltage power supply 130. The Minitron 120 employs an evacuated ceramic tube 148 that houses a filament gas reservoir (not shown), a cathode ion source 142, an accelerating gap between an extraction electrode (not shown) and a copper target 144, and a suppressor electrode 146 surrounding the target 144 with an aperture allowing for the ion beam to pass therethrough to the target 144. The copper target 144 has a metal hydride target face 145 that typically contains deuterium and/or tritium and faces the ion beam formed by the accelerating gap. The Minitron 120 has an exposed Minitron bulkhead 150 on the end opposite the target face 145. The high voltage power supply 130 includes a high voltage power supply (HVPS) bulkhead 152, a high voltage multiplier circuit 154 electrically coupled to the target 144, and a support or "backbone" element 157 which physically holds and supports the components of the voltage multiplier circuit 154. The high voltage power supply 130 generates negative high voltage potentials (i.e., at least −50 kV and more typically −80 kV to −100 kV) that are supplied to the suppressor electrode 146 and target 144 of the Minitron. A large potential difference between the extraction electrode 143 at ground potential and the target 144 causes ions produced by the ion source 142 to accelerate as a particle beam to the target 144 to cause a fusion reaction that generates neutrons. Another byproduct of the fusion reaction is heat. It is not unusual for the target 144 to heat to 30° C. to 50° C. above ambient due to ion bombardment. In order to prevent run-away heating of the Minitron (which can significantly degrade neutron output), the beam power of the Minitron must be carefully controlled or the use of the Minitron can be restricted to low temperature environments. Additionally, the electrical insulation performance of the high voltage insulation degrades with increasing temperature. This is particularly problematic in the vicinity of the Minitron target as it is a region of highest potential and temperature.

Figure 2:
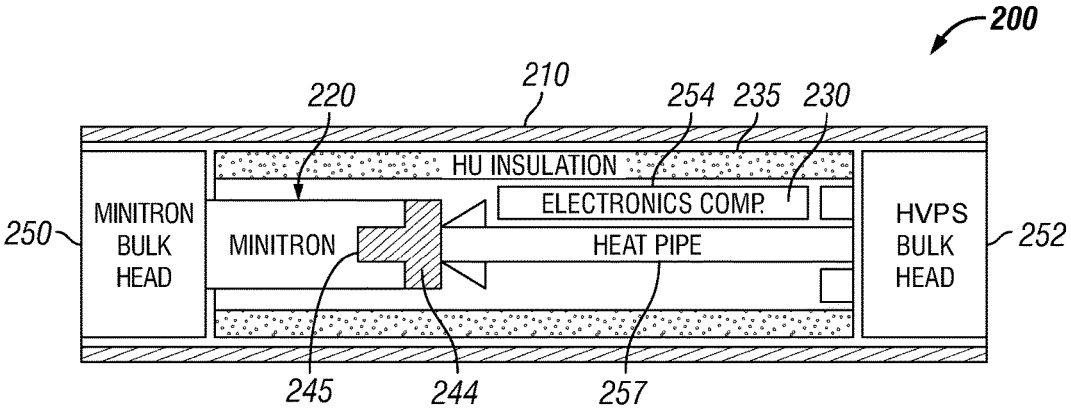
FIG. 2 is a schematic diagram of a pulsed neutron generator according to the invention.

Turning now to FIG. 2, a high level schematic diagram of a pulsed neutron generator 200 of the invention is seen. PNG 200 is provided with an external housing 210 in which a Minitron 220 and a high voltage power supply 230 are located. One or more high voltage insulating sleeves 235 are provided between the external housing 210 and the Minitron 220 and high voltage power supply 230. The Minitron 220 is substantially the same as the Minitron 120 described above, and is shown in FIG. 2 with a copper target 244 having a metal hydride target face 245 that typically contains deuterium and/or tritium and faces the ion beam. The target 244 has an exposed body 250 located on the end of the target 244 opposite the face 245. The high voltage power supply 230 generates a negative high voltage potential (i.e., at least −50 kV and more typically −70 kV to −150 kV) that is applied to the suppressor electrode (not shown) as well as to the target 244 via a resistor. The high voltage power supply 230 includes a high voltage power supply (HVPS) bulkhead 252, a high voltage multiplier circuit 254 electrically coupled to the target 244, and a heat pipe 257 which physically supports the components of the high voltage multiplier circuit 254.

As described in more detail hereinafter, the heat pipe 257 includes a housing 260 (FIG. 3) constructed from a material that is highly electrically resistant and preferably highly thermally conductive. The housing 260 supports and encloses a wick 262 (FIG. 3) as well as heat transfer fluid 264 (FIG. 3), and provides external anchorage for the circuit components 254, while being resistant to high voltage tracking/creep. One end of the heat pipe 257 is preferably disposed in good thermal contact with the exposed target body 250, while the other end is preferably disposed in good thermal contact with the HVPS bulkhead 252.

Figure 3:
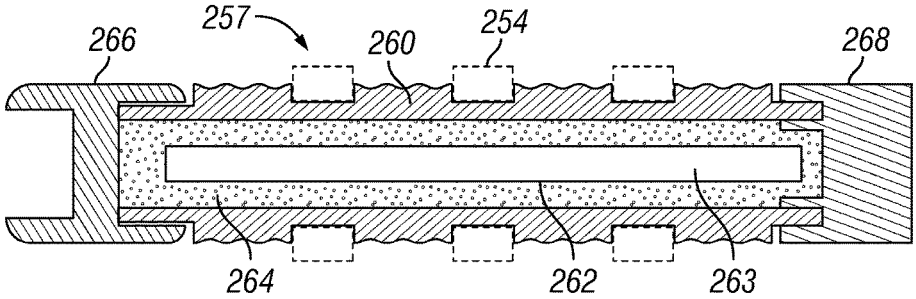
FIG. 3 is a cross-sectional schematic diagram of a heat pipe and supported high voltage multiplier circuit components according to one embodiment of the invention.

Details of a preferred embodiment of the heat pipe 257 and supported high voltage multiplier circuit components 254 of FIG. 2 are seen in the cross-sectional diagram of FIG. 3. As seen in FIG. 3, the exemplary heat pipe 257 includes a cylindrical ceramic body 260 with end-caps 266, 268 disposed on opposite ends of the body 260. The body 260 and end-caps 266, 268 enclose a wick 262 that preferably surrounds an internal cavity 263. The wick 262 provides for circulation of heat transfer fluid 264 within the internal cavity 263 between the hot side adjacent end-cap 266 and the cold side adjacent end-cap 268. More specifically, at the hot side the heat transfer fluid evaporates to vapor absorbing thermal energy. The vapor migrates in the internal cavity 263 to the cold side, where it is condensed back to a liquid. Such condensation releases thermal energy that is transferred to the cold side of the body 260 and the end-cap 268. The liquid phase of the fluid 264 is absorbed by wick 262 at the cold side and flows via capillary action along the wick 262 back to the hot side, where the cycle repeats itself. Because the hot side end-cap 266 is in good thermal contact with the target 244 and the cold side end-cap 268 is in good thermal contact with the HVPS bulkead 252, the circulation of the heat transfer fluid in the heat pipe 257 provides for efficient heat transfer away from the target 244 to the HVPS bulkhead 252 and thus reduces the build up of heat at the target 244. The heat pipe 257 provides for effective thermal conductivity that is significantly greater than traditional passive heat sinks realized from aluminum or copper. In a preferred embodiment, heat pipes provide for thermal conductivity in the range of 50,000 to 200,000 W/m and can move over 15 $W/cm^2$ with a temperature drop of less than 5° C. between the ends of the heat pipe over a wide temperature range.

In the preferred embodiment, the ceramic body 260 of the heat pipe 257 is highly electrically insulating (e.g., has a sheet resistance greater than $10^{14}$ ohms/square), and is also thermally conductive with a thermal conductivity of greater than 20 W/m-K (Watts per meter Kelvin). Suitable materials for realizing the ceramic body 260 include an aluminum nitride (AlN) ceramic, beryllium oxide (BeO)-based ceramic, an aluminum oxide ($Al_2O_3$) ceramic, or from any other material or combinations having those desired characteristics.

In the preferred embodiment, the wick 262 and heat transfer fluid 264 of the heat pipe 257 have a low electrical conductivity. For example, the wick 262 may be realized from ceramic powder, ceramic fiber wick, or glass fibers. The heat transfer fluid 264 can be a pressurized deionized water, possibly a diluted glycol or other suitable heat transfer fluid.

According to one aspect of the invention, the heat transfer fluid 264 (also called the "working fluid") is tuned such that the heat of vaporization (condensation temperature) at the pressure inside the heat pipe is between approximately 180° C. and 220° C., according to the expected operating conditions (i.e., the target temperature relative to the run-away temperature). This allows the working fluid at the hot side of the heat pipe (adjacent end-cap 266) to evaporate as it absorbs thermal energy and release thermal energy as it condenses back to liquid at the cold side of the heat pipe (adjacent end-cap 268) as described above.

According to another aspect of the invention, the end-caps 266, 268 of the heat pipe 257 are made of a highly thermally conductive material such as metal. Where the end-caps 266, 268 are made of metal, special attention should be paid to the geometries of the end-caps 266, 268 as well as to how the end-caps 266, 268 are brazed to the ceramic body 260 of the heat pipe 257 in order to optimize mechanical strength, desired heat transfer properties, and corona-free operations of the assembly.

Figure 4A:
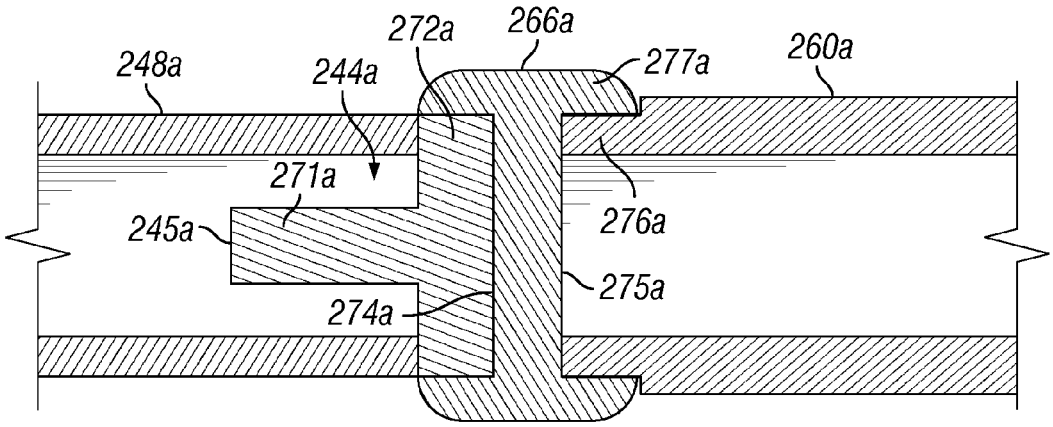
FIGS. 4*a*, 4*b*, and 4*c* are cross-sectional schematic diagrams of first, second, and third embodiments of an interface between the target of the neutron tube (Minitron) and the heat pipe of FIG. 2.
Figure 4B:
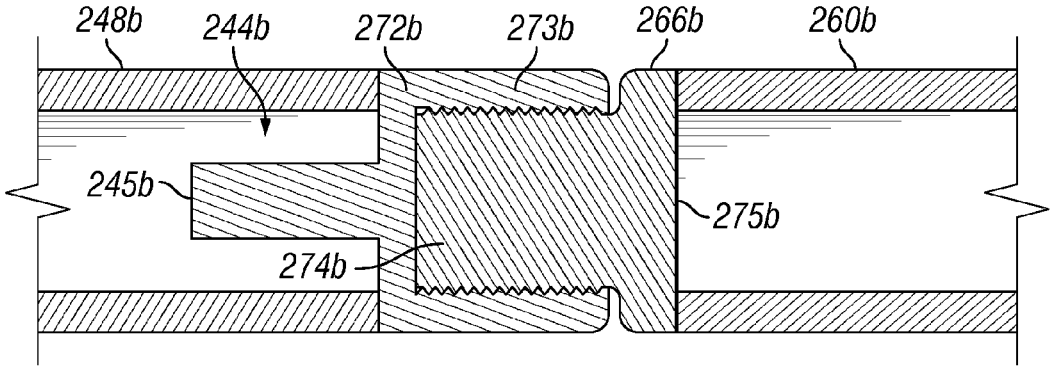
Figure 4C:
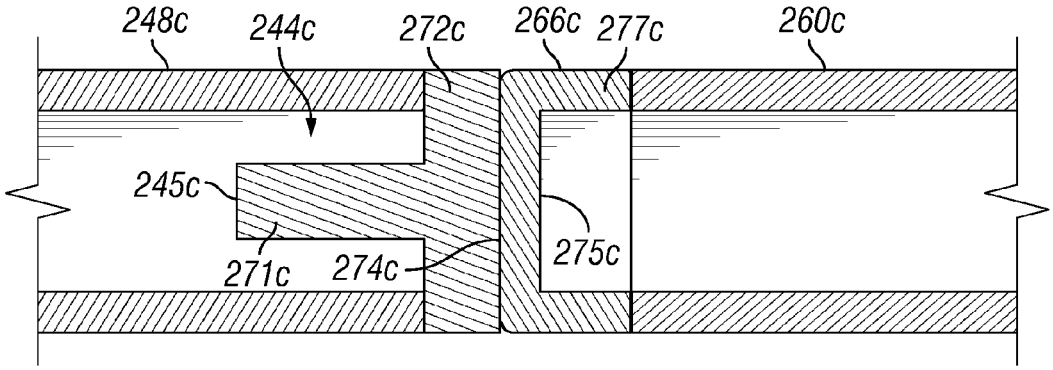

FIGS. 4*a*, 4*b*, and 4*c* are cross-sectional schematic diagrams of first, second, and third embodiments of exemplary interfaces between the target of the Minitron 220 and the higher temperature end of the heat pipe 257 of FIG. 2. In the first embodiment of FIG. 4*a*, a target 244*a* is seen with a target face 245*a* cantilevered from a target base 272*a* by an extension arm 271*a*. Surrounding the target face 245*a* and extension arm 271*a* is a high-voltage ceramic tube 248*a* which is brazed to the forward-facing surface of the target base 272*a* using techniques known in the art. The hot side end-cap 266*a* of the heat pipe 257 is a generally cylindrical cap with opposed receiving indentations 274*a*, 275*a*. A first of the indentations 274*a* receives the target base 272*a*, while the second indentation 275*a* receives the ceramic body 260*a* of the heat pipe 257. The heat pipe body 260*a* includes a stepped reduced diameter end 276*a* that fits inside the indentation 275*a* of the hot side end-cap 266*a* and is mechanically coupled thereto. The coupling may be via brazing or glass frit bonding, or via other techniques known in the art. The hot side end-cap 266*a* is preferably provided with smooth rounded surfaces on its flange 277*a* in order to minimize the risk of localized high electric field inducing corona discharge as shown in FIG. 4*a*.

In the second embodiment of FIG. 4*b*, the target 244*b* includes a target face 245*b* cantilevered from a cup-shaped target base 272*b* by an extension arm 271*b*. Surrounding the target face 245*b* and extension arm 271*b* is a high voltage ceramic tube 248*b* which is brazed to the forward-facing surface of the target base 272*b* using techniques known in the art. The target base 272*b* defines a radial flange 273*b* extending away from the end of the tube 248*b*. The hot side end-cap 266*b* of the heat pipe 257 is a generally annular in shape with a smaller diameter section 274*b* and a larger diameter platform 275*b*. The smaller diameter section 274*b* fits inside the cup-shaped target base 272*b*, while the larger diameter platform 275*b* sits between the ceramic body 260*b* of the heat pipe 257 and the flange 273*b* and is mechanically coupled to the heat pipe body 260*b*. Because the smaller diameter section 274*b* extends inside the target 244*b*, a Faraday cage is created where electric fields are uniform, thereby eliminating the need for a quality surface finish and rounded surfaces within the Faraday cage.

In the third embodiment of FIG. 4*c*, the target 244*c* includes a target face 245*c* cantilevered from a target base 272*c* by an extension arm 271*c*. Surrounding the target face 245*c* and extension arm 271*c* is a high voltage ceramic tube 248*c* which is brazed to the forward-facing surface of the target base 272*c* using techniques known in the art. The hot side end-cap 266*c* of the heat pipe 257 is a cup-shaped cap with a flat face 274*c* on one side and an indentation 275*c* on the other. The flat face 274*c* abuts the target base 272*c*, while the annular surface on flange 277*c* around the indentation 275*a* abuts the ceramic body 260*c* of the heat pipe 257 and is mechanically coupled thereto. The abutting contact of the flat face 274*c* to the target base 272*c* can be maintained by welding, brazing, a spring (FIG. 7), or by other suitable means.

In a fourth embodiment, the target includes a target face cantilevered from a cup-shaped target base by an extension arm. Surrounding the target face and extension arm is a high voltage ceramic tube which is brazed to the forward-facing surface of the target base using techniques known in the art. The target base defines a radial flange extending away from the end of the tube. The hot side end-cap of the heat pipe is a generally annular in shape with a section that fits inside the cup-shaped target base. The hot side end-cap also includes a stepped reduced diameter end that fits inside the hot side of the ceramic body and is mechanically coupled thereto. The coupling may be via brazing or glass frit bonding, or via other techniques known in the art. Because section of the end-cap extends inside the target, a Faraday cage is created where electric fields are uniform, thereby eliminating the need for a quality surface finish and rounded surfaces within the Faraday cage.

It should be appreciated that each of the interfaces of FIGS. 4*a*-4*c* provides a significant amount of surface area contact between the Minitron target and the hot side end-cap of the heat pipe 257 for the transfer of heat energy from the Minitron target to the heat pipe 257. The arrangement of FIG. 4*a* has among others, the advantages of providing a large surface area and permitting both an annular and butt brazing interface between the end-cap 266*a* and the ceramic body 260*a*, but has a footprint that extends wider than the Minitron, and requires accurate dimensions as well as careful surface finish and surface rounding. The arrangement of FIG. 4*b* has among others, the advantage of providing larger surface area and reducing the amount of surface finishing and rounding, yet permits only a butt brazing interface between the ceramic body 260*b* and the end-cap 266*b*. The arrangement of FIG. 4*c* has among others, the advantages of providing a large surface area with a very simple geometry, yet also permits only a butt brazing interface between the ceramic body 260*c* and the end-cap 266*c*. The arrangement in the fourth embodiment has among others, the advantage of providing a larger surface area and reducing the amount of surface finishing and rounding, and permits both an annular and butt brazing interface between the ceramic body 260*b* and the end-cap 266*b*.

According to another aspect of the invention, for the case where the end-caps 266, 268 are realized from metal, the junctions between the end-caps 266, 268 and the ceramic body of the heat pipe 257 is arranged to avoid triple points. A triple point exists where an electrical insulator meets a metal conductor in a gas or vacuum, all in the presence of elevated electric fields. The intersection of electrically different materials facilitates the emission of electrons thereby potentially causing an electrical failure (e.g., leakage currents). To mitigate this potential problem, the metal of the respective end-caps 266, 268 is extended over the ceramic body of the heat pipe, thereby reducing the field by creating a Faraday cage effect.

Figure 5C:
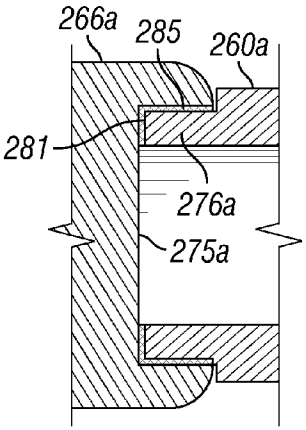
FIGS. 5*a*, 5*b* and 5*c* are cross-sectional schematic diagrams of first, second, and third embodiments of a heat pipe realized by a cylindrical ceramic body with metal end-caps brazed on opposite ends of the ceramic body of the heat pipe; different brazings are used for the embodiments.
Figure 5B:
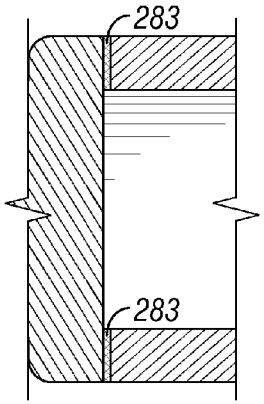
Figure 5A:
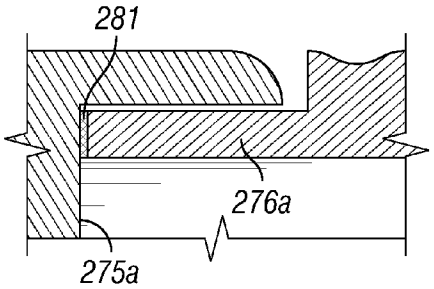

The end-caps 266, 268 may be brazed to the ceramic body. A braze joint can be the site of sharp edges or other features and discontinuities which are sources of unwanted corona discharge. According to another aspect of the invention, an annular braze (also commonly referred to as a "circumferential braze") and/or a butt braze (also commonly referred to as a "face braze") can be used to join the end-caps 266, 268 to the ceramic body. An annular braze joins surfaces that extend generally parallel to the central axis of the ceramic body. A butt braze joins surfaces that extend generally transverse to the central axis of the ceramic body. FIG. 5*a* shows butt braze 281 where the stepped reduced diameter end 276*a* of the body 260*a* is brazed in the indentation 275*a* of the high temperature end-cap 266*a*. The braze 281 extends around the indentation 275*a* and is effectively protected by the metal flange of the end-cap 266*a*. This is similar to the butt braze 283 shown in FIG. 5*b* which most closely corresponds to the junction arrangements shown in FIGS. 4*b* and 4*c* where the ends 260*b*, 260*c* of the body are brazed to the hot side end-caps 266*b*, 266*c*. FIG. 5*c* shows both a butt braze 281 and an annular braze 285 between the reduced diameter end 276*a* of the ceramic body 260*a* and the indentation 275*a* of the hot side end-cap 266*a*. The annular braze 285 is preferably located deep in the indentation 275*a* so that the flange 277*a* can still create a Faraday cage effect.

Figure 6B:
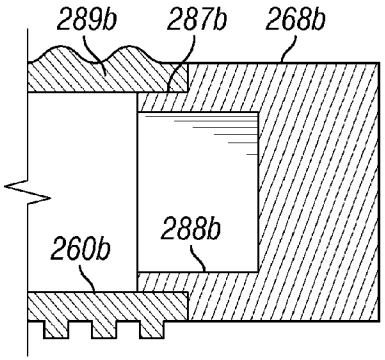
FIGS. 6*a* and 6*b* are cross-sectional schematic diagrams of first and second embodiments of an interface between the heat pipe and high voltage power supply bulkhead of FIG. 2.
Figure 6A:
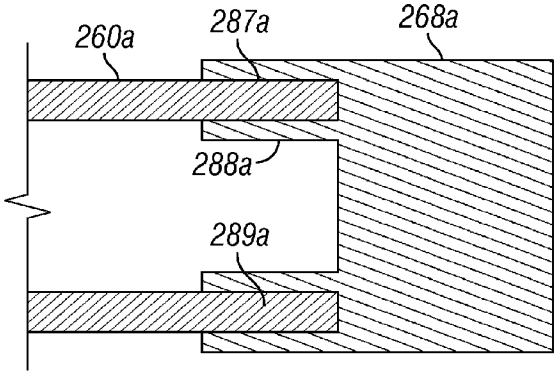

Different embodiments of an exemplary cold side end-cap 268*a* of the heat pipe 257 of FIG. 2 are seen in FIGS. 6*a* and 6*b*. In the embodiment of FIG. 6*a*, the cold-side end-cap 268*a* is shown to be generally cylindrical with concentric indentations 287*a*, 288*a*. The end 289*a* of ceramic body 260*a* is shown to fit inside outer indentation 287*a*, and is physically coupled thereto. Indentation 288*a* provides a larger surface area for transferring heat from the heat pipe fluid to the metal end-cap 268*a*. If desired, additional indentations (not shown) can be provided to act as fins to provide additional surface area for the transfer of heat. Coupling of the end-cap 268*a* to the body 260*a* is preferably via annular and/or butt brazing as previously discussed.

In the embodiment of FIG. 6*b*, the cold side end-cap 268*b* is provided similar to end-cap 268*a* as described above with respect to FIG. 6*a* except that the concentric indentations are substituted by an outer shelf 287*b* around which the end 289*b* of the cearmic body 260*b* is coupled. The inner indentation 288*b* is provided to present a large surface area for transferring heat. The ceramic body 260*b* can be brazed to the end-cap 268*b* by a butt brazing and/or annular brazing. In the approach of FIG. 6*b*, the maximal radial dimension of the end-cap 268*b* can conform to that of the ceramic body 260*b* in order so minimize the radial dimensions of the assembly.

When the metal end-caps 266, 268 are brazed to the ceramic body 260 of the heat pipe, differences in the coefficient of thermal expansion (CTE) of the metal end-cap and the ceramic body 260 can introduce stresses (including shear, tensile and compressive stresses) in the brazing interface. Such stresses can lead to failure of the interface and result in loss of heat transfer fluid from within the ceramic body 260. According to one aspect of the invention, the coupling of the end-caps 266, 268 to the ceramic body 260 of the heat pipe is accomplished with a material that has a coefficient of thermal expansion (CTE) that matches the ceramic material of the body 260. According to another aspect of the invention, the coupling of the end-caps 266, 268 to the ceramic body 260 of the heat pipe is accomplished with a material that has a high thermal conductivity (for good thermal coupling). While KOVAR (a registered trademark of Carpenter Technology Corporation comprising a nickel-cobalt ferrous alloy) has a reasonably good CTE match to certain ceramics (i.e., aluminum oxide ($Al_2O_3$) ceramic), it has a relatively poor thermal conductivity (~17 W/m-K). Thus, according to one embodiment, thermally conductive metals such as copper or aluminium can be explosively bonded to a thin layer or sheet of KOVAR (or other material with a CTE matching the ceramic of the body) which is then brazed to the ceramic body. In this manner, the coupling between the respective end-cap 266, 268 and the ceramic body 260 will have a reasonably good CTE match to both the end-cap 266, 268 and the ceramic body 260 and provide a relatively good composite thermal conductivity. In another embodiment, thermal expansion matching can be provided by a stress relief washer that joins the respective end-cap 266, 268 to the ceramic body 260. The stress relief washer, which can have a bellows design and/or can be realized from a ductile material, deforms to take the strain produced by differences in the thermal expansion of the joined parts.

According to another aspect of the invention, good thermal contact between the heat pipe 257 and the target 244 (the heat source) as well as between the heat pipe 257 and the HVPS bulkhead 252 (the heat sink) should be maintained at all times. In this configuration, the ceramic body 260 of the heat pipe 260 can experience a not-insignificant change in length due to linear thermal expansion. To prevent buckling of the body 260, the dimensional changes are preferably accommodated. Thus, according to one aspect of the invention, a spring can be disposed between cold-side end-cap 168 of the heat pipe and the HPVS bulkhead 252. The spring applies a bias force that urges the heat pipe 257 toward the Minitron such that the hot-side end-cap 266 maintains good contact with the target.

Figure 7:
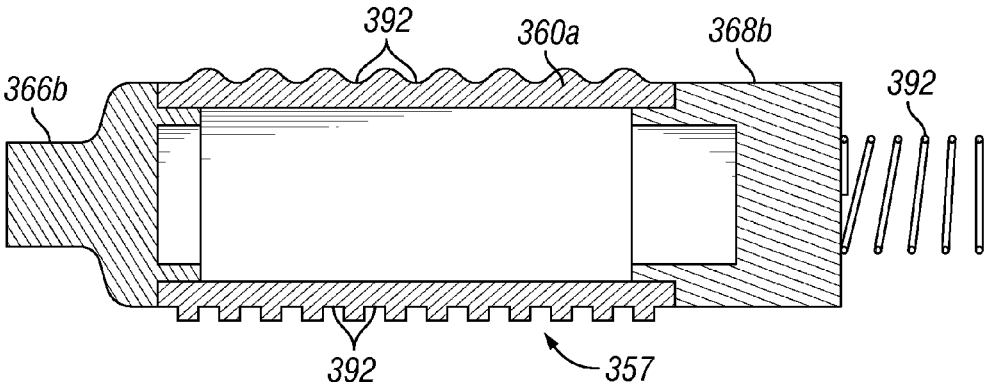
FIG. 7 is a cross-sectional schematic diagram of a heat pipe according to another embodiment of the invention with a spring utilized for interfacing the heat pipe to the target of the Minitron.

An example of a heat pipe utilizing a spring is seen in FIG. 7 where heat pipe 357 is shown with a spring 392, a cold side end-cap 368*b* which is substantially identical to end-cap 268*b* of FIG. 6*b*, and a hot side end-cap 366*b* which is similar to end-cap 266*b* of FIG. 4*b* except that end-cap 366*b* is provided with a flange 391 that provides a surface for an annular braze as well as providing additional heat transfer surface area. The spring 392 is disposed between the cold side end-cap 368*b* and the HPVS bulkhead 252. The spring 392 applies a bias force that urges the heat pipe 257 toward the Minitron such that the hot side end-cap 366*b* maintains good contact with the target. The outer surface of the ceramic body 360*a* of heat pipe 357 is provided with grooves or corrugations 394 to reduce the likelihood of high voltage tracking by lengthening the electrical path between the end-caps. The high voltage multiplier circuit components supported by the ceramic body 260*a* of the heat pipe 357 are not shown in FIG. 7. Thermally conductive paste or filler material can be disposed in the space between the cold side end-cap 368*b* and the HPVS bulkhead 252 (not shown) to provide for enhanced heat transfer between the end-cap 368*b* and the HPVS bulkhead 252 and accommodate the movement of the heat pipe 357. Typically, a silicone-based material could be used as the thermally-conductive paste or filler material. One of the metal end-caps 366*b*, 368*b* (preferably the cold side end-cap 368*b* as shown in FIG. 7) can contain a fill port 393 for filling the heat pipe with heat transfer fluid. This fill port 393 can be a threaded design with a cap or can be a pinch-off design. The fill port 393 can be open to allow for venting during the brazing operation to allow air to be released from inside the heat pipe. After assembly is complete, the heat transfer fluid can be supplied through the fill port 393 into the interior space of the heat pipe and the fill port 393 closed, for example by a threaded plug. The fill port 393 can also be used to empty and refill the heat transfer fluid as needed.

In an alternate embodiment, instead of providing a spring applying a biasing force to the heat pipe, it is possible to provide a spring that applies a biasing force that urges the Minitron toward the heat pipe and maintain good contact between the target of the Minitron and the heat pipe. In this configuration, the heat pipe is solidly anchored to the housing of the PNG. Expansion of the heat pipe can then be accommodated by movement of the Minitron relative to the heat pipe as provided by the spring.

According to another aspect of the invention, in order to further optimize the heat transfer between the target and the hot end of the heat pipe, the surfaces of the target and the hot side end-cap of the heat pipe are very-well finished without grooves and scratches. Moreover, an extremely thin layer of highly thermally conductive and easily compressible paste or filler material (e.g., Gap-Pad™ thermal materials commercially available from the Bergquist Company of Chanhassen, Minn.) can be used at the interface of the target and the hot side end-cap of the heat pipe. Typically, a silicone-based material could be used as the thermally-conductive paste or filler material.

Figure 8A:
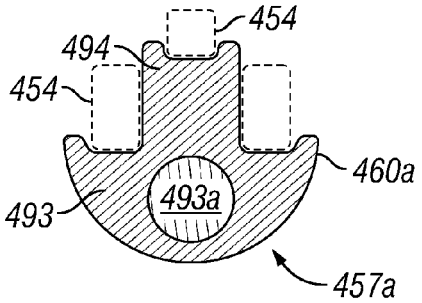
FIGS. 8*a* and 8*b* are cross-sections through first and second exemplary heat pipe backbones with high voltage multiplier circuit components arranged in different configurations.

As previously mentioned, the ceramic body of the heat pipe is used as a backbone to support components of the high voltage multiplier circuit. While the heat pipe bodies of the embodiments shown in FIGS. 3, 4*a*-4*c*, etc. are shown to be generally cylindrical, with a corrugated or grooved but generally cylindrical outer surface, and defining a generally cylindrical area for the wick and cavity, it should be appreciated that the heat pipe body can take various configurations. By way of example, in FIG. 8*a*, a heat pipe 457*a* is shown in cross-section with a body 460*a* defining an oval area 493*a* for receiving the wick and fluid. The external shape of the body 460*a* includes a generally half-cylindrical base 493, with a platform 494 extending out from the diameter of the base. The edges of the exterior surface of the half-cylindrical base and the platform are curved to form a shelf or pockets for the high-voltage ladder components 454 which are situated on three sides of the body 460*a*.

Figure 8B:
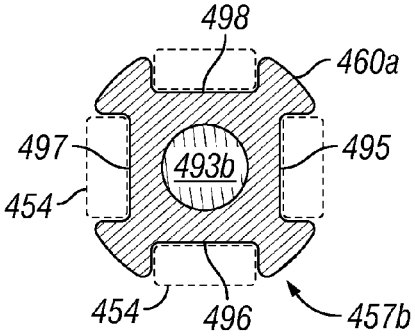

A heat pipe 457*b* with a different shaped body 460*b* is seen in FIG. 8*b*. A cross-section through body 460*b* shows the body 460*b* to define a generally a circular area 493*b* for receiving the wick and fluid. The exterior surface of the body 460*b* is generally square with rounded edges (or generally round) with channels 495, 496, 497, 498 cut therein on the four sides for receiving the components of the high voltage multiplier circuit 454.

In an embodiment, a pulsed neutron generator according to the invention is provided with an external metal housing in which a Minitron is located. The Minitron is substantially the same as the Minitron 220 described above, with a copper target having a metal hydride target face that typically contains deuterium and/or tritium and faces the ion beam formed by the Minitron. The gas reservoir and ion source of the Minitron are not shown for the sake of simplicity of the drawing. A Minitron bulkhead is located on the end opposite the target and provides an electrical connector for receiving electrical power supply signals (typically low voltage DC supply signals) for transmission to feedthroughs (not shown) that connect to the ion source and gas reservoir of the Minitron for secondary electron suppression from the target as is well known in the art.

A high voltage power supply including a high voltage power supply (HVPS) bulkhead and a high voltage multiplier circuit is also provided within the external housing. The HVPS bulkhead (or a housing mounted thereto) includes a connector for receiving AC electrical power supply signals that energize a transformer mounted therein with an oscillating signal. The high voltage multiplier circuit comprises a Cockcroft-Walton circuit of discrete components (capacitors and diodes) that are wired together in a ladder circuit that multiples the power output from the transformer as is well known. In the embodiment shown, the high voltage multiplier circuit generates a negative high voltage potential (i.e., at least −50 kV and more typically −80 kV to −100 kV) at the output node of the high voltage multiplier circuit. This output voltage is supplied to the suppressor electrode of the Minitron via a conductive wire (and/or shield and/or spring contact) that provides an electrical pathway between the output node of the high voltage multiplier circuit and the suppressor electrode. A high voltage resistor is electrically connected between the suppressor electrode and the target to provide a desired negative potential voltage difference between the suppressor electrode and the target as is well known in the art.

A heat pipe is also located within the external housing between the HVPS bulkhead and the target of the Minitron. The exterior surface of the ceramic body of the heat pipe physically holds and supports components (e.g., capacitors, diodes and interconnects) of the high voltage multiplier circuit in the manner described herein. The heat pipe 1057 is disposed in thermal contact with the target of the Minitron as well as with the HVPS bulkhead. The heat pipe houses an internal wick and heat transfer fluid (not shown). The wick circulates heat transfer fluid within heat pipe in order to transfer heat away from the target to the HVPS bulkhead. Different embodiments of the heat pipe are described herein. High voltage insulation (e.g., one or more high voltage insulating sleeves) is provided between the external housing and the Minitron and between the external housing and the heat pipe and the high voltage multiplier circuit components mounted thereon. The high voltage insulation can be realized from a perfluoroalkoxy copolymer (PFA) or other suitable material. The high voltage insulation 1035 can also be realized from insulating gases such as sulfur hexafluoride (SF6).

It will be appreciated by those skilled in the art that the components (e.g., capacitors and diodes) of the high voltage multiplier circuit can experience degradation of performance and failure at very high temperatures. Since the heat pipe is thermally conductive, the circuit components, particularly at the hotter end of the heat pipe, are susceptible to experiencing excessive temperatures. According to one aspect of the invention, in order to mitigate the susceptibility of the circuit components at the hot end of the heat pipe to excessive heat, a thermal insulation (e.g., PFA) may be applied between the body and the high voltage multiplier circuit components.

Figure 9:
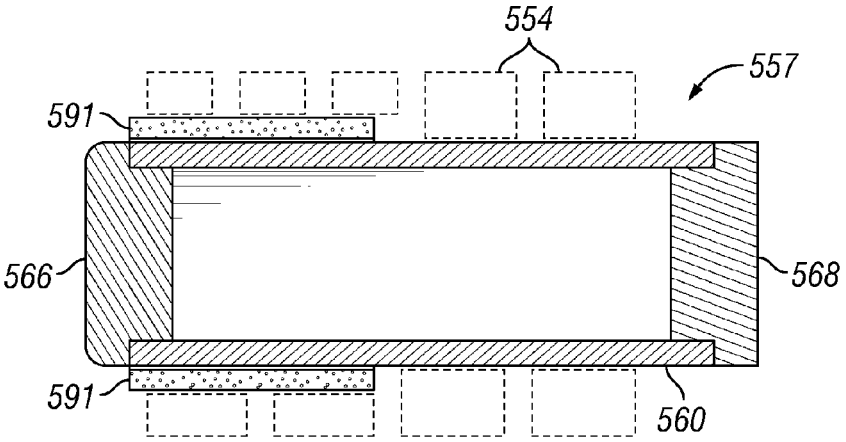
FIG. 9 is a cross-sectional schematic diagram of a heat pipe according to another embodiment of the invention which is provided with thermal insulation at the end of heat pipe adjacent the target of the Minitron, wherein the thermal insulation is disposed between the heat pipe and high voltage multiplier circuit components.

A heat pipe provided with PFA insulation between the exterior of the ceramic body and the high voltage multiplier circuit components at the hot end of the ceramic body is shown in FIG. 9. More particularly, the heat pipe 557 is provided with a ceramic body 560, end-caps 566, 568, and PFA insulation 599 around the body 560 at the hot end of the heat pipe 557. Components of the high voltage multiplier circuit 554 are arranged around the body 560 and over the PFA insulation 599. In FIG. 9, the PFA insulation 599 is shown extending about 40% of the way along the body 560 and thus does not extend to the cold end of the body 560. However, it will be appreciated that the PFA insulation can extend the entire length of the housing, or along a smaller or larger length of the housing. It is noted that the end-caps 566, 568 are shown as being generally cylindrical with centrally extending centering features, thereby providing annular shelves to which the body 560 can be brazed. It will be appreciated by those skilled in the art that other caps such as shown in FIGS. 4*a*-4*c*, 6*a*, 6*b* and 7, or with other arrangements could be utilized.

The heat pipe arrangement of the present invention is particularly useful as part of a PNG which may be used in a borehole. According to one aspect of the invention, the PNG is arranged such that the Minitron of the PNG is located "below" the heat pipe and HVPS bulkhead of the PNG, so that when the PNG is lowered into a borehole, the Minitron enters first. In this manner, the hotter end of the heat pipe is located below the relatively cooler end of the heat pipe, and gravity will assist the heat transfer operations of the heat pipe when the PNG is in a vertical orientation (e.g., in a vertical well).

There have been described and illustrated herein several embodiments of a PNG incorporating a heat pipe for transferring heat away from a target and supporting components of a high voltage multiplier circuit that generates high voltage signals for supply to the target. While particular heat pipe geometries have been described, it will be appreciated that others could be utilized. Also, while particular hot side end-caps and cold side end-caps for the heat pipe have been described, it will be appreciated that any of the described end-cap arrangements can be used for either the hot side or cold side end-caps. In fact, other end-cap geometries can be utilized. Further, while particular materials were described for use for the heat pipe body and the end-caps, it will be appreciated that other materials can be utilized, provided desirable electrical and thermal performances are maintained. In addition, while the heat pipe has been described as being in thermal contact with the target of the Minitron, it should be appreciated by those skilled in the art that the hot side end-cap of the heat pipe could be joined (e.g., welded), or could be integral with the target. Moreover, the target of the Minitron could be used as the hot side end-cap of the heat pipe, and the ceramic heat pipe housing could be welded or brazed directly to the target of the Minitron. Also, while various types of welds and materials for welding have been described, it will be appreciated that other materials can be utilized, and other techniques for sealing the heat pipe and/or provided CTE stress relief could be utilized. Also, while particular types of Minitron designs have been described, the designs and arrangements of the present invention can be used in other-types of particle accelerators, such as x-ray sources and gamma ray sources. It will therefore be appreciated by those skilled in the art that yet other modifications could be made to the provided invention without deviating from its spirit and scope as claimed.

What is claimed is:

1. An apparatus for downhole logging, comprising:

a) an enclosure having a metal target having a target face that generates neutrons in response to bombardment of ions accelerated thereto;

b) a high voltage power supply including (i) a high voltage power supply (HVPS) bulkhead and (ii) a plurality of electronic components electrically coupled to said target, wherein said plurality of electronic components generate a voltage with a magnitude of at least 50 kV; and c) a heat pipe disposed between said HVPS bulkhead and said target, said heat pipe having a housing portion with an exterior surface supporting said plurality of electronic components of said high voltage power supply, said heat pipe being in thermal contact with said target and comprising a wick and heat transfer fluid disposed within said housing portion, the wick for circulating the heat transfer fluid within the housing portion in order to transfer heat away from the target to said HVPS bulkhead.

2. An apparatus according to claim 1, wherein:

said heat pipe is in thermal contact with said HVPS bulkhead and transfers heat from said target to said HVPS bulkhead.

3. An apparatus according to claim 1, wherein:

said housing portion of said heat pipe has an electrical sheet resistance greater than $10^{14}$ ohms/square.

4. An apparatus according to claim 1, wherein:

said housing portion of said heat pipe has a thermal conductivity of greater than 20 W/m-K (watts per meter Kelvin).

5. An apparatus according to claim 1, wherein:

said housing portion of said heat pipe is realized from a ceramic material.

6. An apparatus according to claim 5, said ceramic material is selected from the group including aluminum nitride (AlN) ceramic, beryllium oxide (BeO) ceramic, aluminum oxide ($Al_2O_3$) ceramic, and combinations thereof.

7. An apparatus according to claim 1, wherein:

said wick is realized from a material selected from the group including ceramic powder, ceramic fiber, glass fibers, and combinations thereof.

8. An apparatus according to claim 1, wherein:

said heat transfer fluid is pressurized within said housing portion.

9. An apparatus according to claim 8, wherein:

said heat transfer fluid is selected from the group including deionized water, diluted glycol, and combinations thereof.

10. An apparatus according to claim 1, wherein:

said heat pipe includes a metal end-cap in thermal contact with said target.

11. An apparatus according to claim 10, wherein:

said target includes a cup-shaped structure that receives and surrounds a portion of said metal end-cap.

12. An apparatus according to claim 10, wherein:

said target includes a flat surface facing said heat pipe, and said metal end-cap includes a flat surface that abuts said flat surface of said target.

13. An apparatus according to claim 10, wherein:

said metal end-cap is mechanically coupled to said target by mating structures of said metal end-cap and said target.

14. An apparatus according to claim 10, wherein:

said metal end-cap is mechanically coupled to said target by welding or brazing.

15. An apparatus according to claim 10, wherein:

said metal end-cap is mechanically coupled to said housing portion of said heat pipe with a brazing.

16. An apparatus according to claim 15, wherein:

said brazing has a thermal coefficient of expansion that matches both said metal end-cap and said housing portion of said heat pipe.

17. An apparatus according to claim 16, wherein:

said brazing comprises a metal explosively bonded to a nickel-cobalt ferrous alloy sheet.

18. An apparatus according to claim 15, wherein:

said brazing is at least one of an annular brazing, a circumferential brazing, and a butt brazing.

19. An apparatus according to claim 1, wherein:

said housing portion of said heat pipe has an exterior surface with corrugations or grooves, and said plurality of electronic components are supported within said corrugations or grooves.

20. An apparatus according to claim 1, further comprising:

thermal insulation disposed between at least some of said plurality of electronic components and said housing portion of said heat pipe.

21. An apparatus according to claim 1, further comprising:

an outer housing in which said enclosure and said high voltage power supply are housed; and a spring coupled to one of said enclosure and said HVPS bulkhead which urges said heat pipe into contact with said target.

22. An apparatus according to claim 1, wherein:

said enclosure supports a gas reservoir, an ion source, and said target.

23. An apparatus according to claim 22, wherein:

said ion source is operated around ground potential and said high voltage power supply generates a negative voltage of at least −50 kV for supply to said target.

24. An apparatus according to claim 22, wherein:

said enclosure further supports a suppressor electrode, and said high voltage power supply generates a negative voltage of at least −50 kV for supply to said suppressor electrode.

25. An apparatus according to claim 22, wherein:

said high voltage power supply includes a resistor electrically coupled between said suppressor electrode and said target for generating a positive voltage differential between said suppressor electrode and said target.

26. A particle accelerator for downhole logging, comprising:

a) an enclosure having a metal target having a target face that generates radiation in response to bombardment of particles accelerated thereto;

b) a high voltage power supply including (i) a high voltage power supply (HVPS) bulkhead and (ii) a plurality of electronic components electrically coupled to said target, wherein said plurality of electronic components generate a voltage with a magnitude of at least 50 kV; and c) a heat pipe disposed between said HVPS bulkhead and said target, said heat pipe having a housing portion with an exterior surface supporting said plurality of electronic components of said high voltage power supply, said heat pipe being in thermal contact with said target and comprising a wick and heat transfer fluid disposed within said housing portion, the wick for circulating the heat transfer fluid within the housing portion in order to transfer heat away from the target.

27. A particle accelerator according to claim 26, wherein: said heat pipe is in thermal contact with said HVPS bulkhead and transfers heat from said target to said HVPS bulkhead.

28. A particle accelerator according to claim 27, wherein: the radiation generated by the target face comprises neutrons.

* * * * *